United States Patent [19]

Babler

[11] 4,338,034

[45] Jul. 6, 1982

[54] PRINT WHEEL POSITIONING MEANS

[75] Inventor: Egon S. Babler, Northbrook, Ill.

[73] Assignee: Xerox Corporation, Stamford, Conn.

[21] Appl. No.: 141,445

[22] Filed: Apr. 18, 1980

[51] Int. Cl.[3] ..... B41J 1/24

[52] U.S. Cl. ..... 400/144.2; 400/175

[58] Field of Search ..... 400/144.2, 144.3, 144.4, 400/174, 175, 171, 172

[56] References Cited

U.S. PATENT DOCUMENTS

| | | | |
|---|---|---|---|
| 3,677,386 | 7/1972 | Herterich | 400/144.2 |
| 3,983,985 | 10/1976 | Guerrini et al. | 400/175 X |
| 4,037,706 | 7/1977 | Sohl et al. | 400/144.2 |
| 4,119,384 | 10/1978 | Keiter | 400/144.2 |
| 4,124,312 | 11/1978 | Johnson | 400/320 X |
| 4,198,169 | 4/1980 | Stuiber et al. | 400/144.2 |

FOREIGN PATENT DOCUMENTS

| | | | |
|---|---|---|---|
| 2521027 | 12/1975 | Fed. Rep. of Germany | 400/144.2 |
| 2022022 | 12/1979 | United Kingdom . | |

*Primary Examiner*—Edgar S. Burr
*Assistant Examiner*—Charles Pearson
*Attorney, Agent, or Firm*—Richard A. Tomlin

[57] ABSTRACT

An impact printer of the type wherein a print wheel is rotated to a print position by a drive motor, and printing is caused by impacting a particular character on the print wheel by a print hammer. The print wheel has coarse alignment and fine alignment means formed in the print wheel. The coarse alignment means is used to drive the wheel, and the fine alignment means is utilized during hammer impact.

4 Claims, 4 Drawing Figures

PRINT WHEEL POSITIONING MEANS

The invention relates to serial printing devices and, more particularly, to high-speed serial printers having print fonts arranged upon a disc member, which disc member rotates the fonts past an impacting printing hammer. In a high-speed, high-quality printing system, it is necessary to accurately and quickly position the disc member so that the printed characters will be aligned and spaced correctly. Heretofore, expensive and complicated systems have been utilized to provide the positional accuracy required. Attempts to utilize, for example, inexpensive stepper motors in such systems have not been totally successful.

The invention as claimed is intended to provide a remedy. It solves the problem of how to utilize inexpensive stepper motors in high-speed printers without sacrificing alignment or spacing accuracy. The print wheel positioning means of this invention utilizes two sets of positioning means; one, a coarse alignment means connected to the drive motor; and the second, a fine alignment means, which is stationary and comes into play only after the coarse alignment means has been deactivated. The print wheel disc contains mating coarse and fine aligning means. The print wheel is described in detail in my copending application Ser. No. 141,442, filed Apr. 18, 1980 now abandoned in favor of continuing application Ser. No. 207,977 filed Nov. 3, 1980, in the U.S. Patent and Trademark Office, the disclosure of which is hereby incorporated by reference.

One way of carrying out the invention is described in detail below with reference to the drawing, which illustrates two specific embodiments, in which.

For clarity of understanding, the same or similar parts are given the same designations in the various figures.

Figure 2:
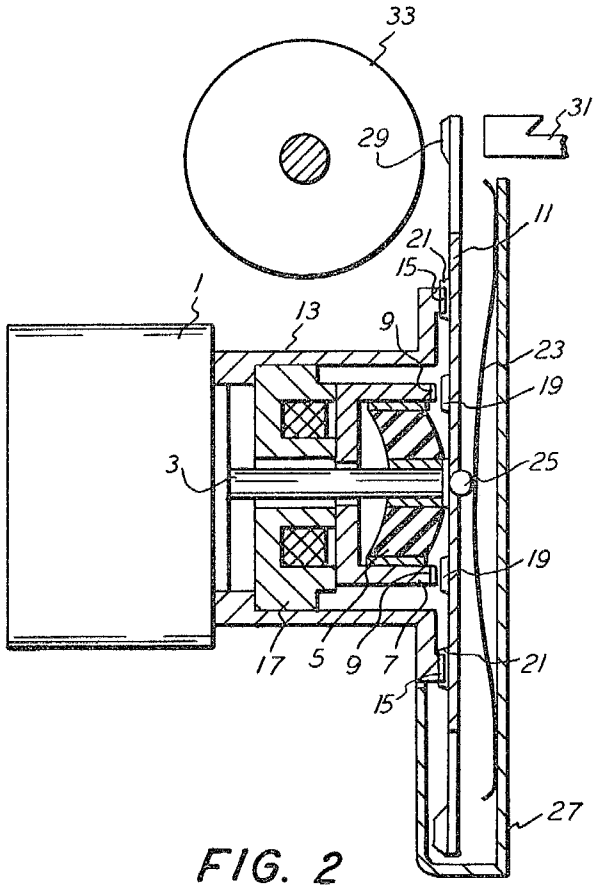
FIG. 2 is a side-view schematic representation of the print wheel alignment means of this invention in the fine aligning mode.
Figure 1:
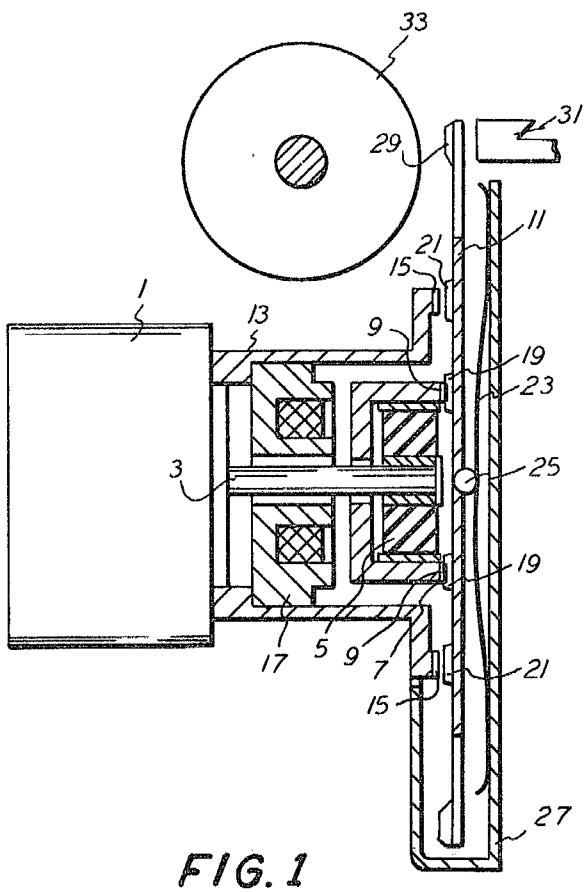
FIG. 1 is a side-view schematic representation of the print wheel aligning means of this invention in the drive mode.

Referring now to FIGS. 1 and 2, there is seen stepper motor 1 having drive shaft 3 mounted thereon for rotation. Attached to drive shaft 3 is flexible member 5 which may be, for example, a spring or a rubber disc, which spring or rubber disc is flexible in the axial direction relative to the drive shaft 3. In turn, fixed to flexible member 5 is ferromagnetic, axially movable coupling drive member 7, which has drive teeth 9 formed thereon. Flexible member 5 is designed to bias drive member 7 towards the print wheel, generally designated as 11. Attached to fixed stepper motor body 1 is stationary coupling support housing 13, which has stationary fine alignment teeth 15 mounted or formed thereon. Housing 13 also supports electromagnet 17, which is located and of strength such that when activated, it will pull drive member 7 axially with respect to drive shaft 3 away from print wheel 11 as shown in FIG. 2. The movement of drive member 7 is sufficient to disconnect drive teeth 9 from mating print wheel teeth 19 and to allow teeth 21 on print wheel 11 to contact fixed fine alignment teeth 15. Although in FIG. 2 teeth 19 are shown completely separated from drive teeth 9, it is not necessary to back off drive member 7 more than a very small amount to loosen its grip on print wheel 11 and allow contact with teeth 15. Drive teeth 9 are shown separated from print wheel teeth 19 for purposes of explanation only. Print wheel 11 is urged into contact with fine alignment teeth 15 by plate spring 23 acting through ball pivot 25. Plate spring 23 is mounted in print wheel cartridge case 27.

In operation, stepper motor 1 is activated and by means of a controller (not shown) directed to turn shaft 3 to one of 100 radial positions corresponding to the character desired to be printed. In this example, it is assumed that there are 25 coarse alignment drive teeth 9 and 19 and 100 fine alignment teeth 15 and 21. Since electromagnet 17 is not activated during the drive cycle, coarse alignment drive teeth 9 and print wheel drive teeth 19 are in contact, as shown in FIG. 1, with plate spring 23 urging print wheel drive teeth 19 into contact with drive shaft drive teeth 9. Ball 25 acts as a pivot for radial rotation of print wheel 11. When a desired character 29 is aligned with print hammer 31, drive shaft 3 stops, which coarsely aligns character 29 with platen 33. Electromagnet 17 is then activated, which pulls drive member 7 away from print wheel 11 sufficiently to uncouple coarse alignment drive teeth 9 and 19 as shown in FIG. 2. As drive member 7 is pulled away from print wheel 11 by electromagnet 17, plate spring 23 acting through ball pivot point 25 pushes print wheel 11 to the left, as seen in FIG. 2, so that fixed fine alignment positioning teeth 15 and print wheel fine alignment teeth 21 are in contact. This provides fine alignment of character 29 so that when print hammer 31 is activated, character 29 will be in the correct position relative to platen 33. Normally, a print ribbon (not shown) and print receiving paper (not shown) are provided between character 29 and platen 33.

Figure 3:
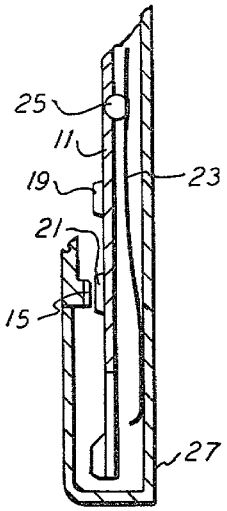
FIG. 3 is a partial side-view schematic showing another embodiment for the fine alignment or positioning means.

FIG. 3 shows a partial side-view schematic of another useful embodiment of the present invention. Here the fixed fine alignment teeth 15 are located on the print wheel cartridge case 27 itself instead of on a housing 13 connected to the stepper motor 1 as in FIGS. 1 and 2. In the embodiment shown in FIG. 3, when the drive wheel is pulled away from print wheel 11, plate spring 23 mounted on cartridge 27 urges print wheel 11 to the left as shown in FIG. 3 until fine alignment print wheel teeth 21 are brought into contact with fixed fine alignment teeth 15, which thereby accomplishes the fine positioning of print wheel 11.

Figure 4:
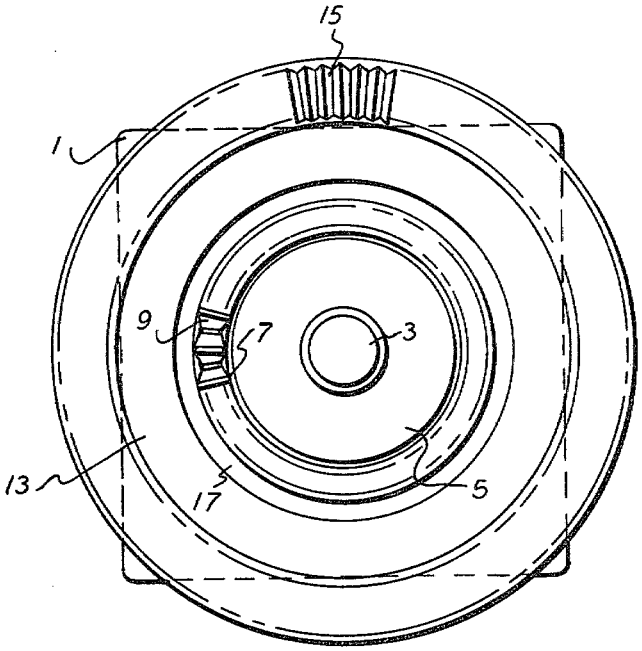
FIG. 4 is an end view of the print wheel drive showing the coarse aligning drive teeth and the fine alignment teeth or serrations.

FIG. 4 shows a stepper motor 1 arrangement with fixed fine alignment teeth 15 and movable coarse alignment drive teeth 9. As explained in detail in connection with FIGS. 1 and 2, drive teeth 9 are mounted for rotation to coarse position the print wheel 11 and also are mounted for axial movement so that the coarse alignment means can be disengaged from print wheel 11 allowing print wheel 11 to contact fine alignment means 15.

Other advantages of the present invention are that the radially extending teeth 9, 19, 15 and 21 center the print wheel with great accuracy and rigidity. Further, wear does not affect the accuracy of this positioning device. The fewer number of teeth on the drive member 7 allows for a greater misalignment between print wheel 11 and drive member 7 when they are being engaged.

While the principles of the invention have been made clear in the illustrative embodiments, there will be many modifications in structure, arrangement, proportions, etc., which will occur to those skilled in the art. The appended claims are, therefore, intended to cover and embrace any such modifications within the scope and spirit of the invention.

What is claimed is:

1. A print wheel aligning apparatus comprising a print wheel mounted for rotation, said print wheel having coarse alignment means and fine alignment means thereon, drive means for rotating said print wheel, said drive means mounted for movement into and out of contact with said coarse alignment means, means for moving said drive means into and out of contact with said coarse alignment means, fixed fine alignment means positioned to contact said fine alignment means on said print wheel and provide fine alignment thereof, a housing structure, said fixed fine alignment means being fixed in both axial and rotative directions relative to said housing, and means to urge said print wheel fine alignment means into contact with said fixed fine alignment means when said drive means is moved out of contact with said coarse alignment means.

2. The apparatus of claim 1 wherein said coarse alignment means is radial teeth formed on said print wheel and said drive means includes matching radial teeth for mating with said coarse alignment means radial teeth.

3. The apparatus of claim 2 wherein said print wheel fine alignment means is radial teeth formed on said print wheel, and said fixed fine alignment means is radial teeth for mating with said print wheel fine alignment radial teeth.

4. The apparatus of claim 1 wherein said print wheel is mounted for rotation within a cartridge, and said cartridge has said fixed fine alignment means formed thereon.

* * * * *

UNITED STATES PATENT AND TRADEMARK OFFICE

CERTIFICATE OF CORRECTION

PATENT NO. : 4,338,034

DATED : July 6, 1982

INVENTOR(S) : Egon S. Babler

It is certified that error appears in the above-identified patent and that said Letters Patent are hereby corrected as shown below:

Column 1, line 29, change "Ser. No. 207,977" to read --Ser. No. 202,977--.

Signed and Sealed this

*Seventh* Day of *September 1982*

[SEAL]

*Attest:*

GERALD J. MOSSINGHOFF

*Attesting Officer*

*Commissioner of Patents and Trademarks*